United States Patent [19]

Studebaker et al.

[11] 4,194,789

[45] Mar. 25, 1980

[54] STAGGERED ARRAY OF EXPLOSIVES FOR FRAGMENTED OIL SHALE FORMATION TOWARD A VERTICAL FREE FACE

[75] Inventors: Irving G. Studebaker; Ned M. Hutchins, both of Grand Junction, Colo.

[73] Assignee: Occidental Oil Shale, Inc., Bakersfield, Calif.

[21] Appl. No.: 4,425

[22] Filed: Jan. 18, 1979

[51] Int. Cl.[2] ..... E21C 41/10

[52] U.S. Cl. ..... 299/2; 102/23; 299/13

[58] Field of Search ..... 299/2, 13; 102/23; 166/299

[56] References Cited

U.S. PATENT DOCUMENTS

| | | | |
|---|---|---|---|
| 2,730,187 | 1/1956 | Hawkins et al. | 102/23 X |
| 3,973,497 | 9/1974 | Coursen | 299/13 X |
| 4,025,115 | 5/1977 | French et al. | 299/2 |
| 4,043,595 | 8/1977 | French | 299/2 |
| 4,043,596 | 8/1977 | Ridley | 102/23 |
| 4,147,388 | 4/1979 | French | 299/2 |

*Primary Examiner*—Ernest R. Purser
*Attorney, Agent, or Firm*—Arnold Grant

[57] ABSTRACT

Oil shale formation is explosively expanded toward a limited void volume for forming an in situ oil shale retort in a subterranean formation containing oil shale. In one embodiment, a void in the form of a vertical slot is excavated within a retort site, leaving at least one portion of unfragmented formation within the retort site adjacent a vertical free face of the slot. Explosive is placed in at least two rows of vertical blasting holes in the remaining portion of unfragmented formation adjacent the vertical free face. The blasting holes in each row are mutually spaced apart along the length of the slot and longitudinally offset from blasting holes in the next adjacent row, and the row of blasting holes extends generally parallel to the vertical free face. Explosive in the blasting holes is detonated in a time delay sequence starting near one end of the slot and progressing along the length of the slot for explosively expanding formation in the remaining portion of unfragmented formation toward the vertical free face for forming a fragmented permeable mass of formation particles containing oil shale in an in situ oil shale retort.

31 Claims, 3 Drawing Figures

STAGGERED ARRAY OF EXPLOSIVES FOR FRAGMENTED OIL SHALE FORMATION TOWARD A VERTICAL FREE FACE

BACKGROUND OF THE INVENTION

This invention relates to in situ recovery of shale oil, and more particularly, to techniques involving the excavation and explosive expansion of oil shale formation in preparation for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598 and 4,118,071 which are incorporated herein by this reference. These patents describe in situ recovery of liquid and gaseous hydrocarbon materials from a subterranean formation containing oil shale, wherein such formation is explosively expanded for forming a stationary, fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

Techniques used for explosively expanding formation toward the void space in a retort site can affect the permeability of the fragmented mass. It is desirable to form a fragmented mass having a distribution of void fraction suitable for in situ oil shale retorting; that is a fragmented mass having reasonably uniform permeability in horizontal planes across the fragmented mass through which oxygen-supplying gas can flow relatively uniformly during retorting operations. Gas channeling through the fragmented mass can occur when there is non-uniform permeability.

A fragmented mass of reasonably uniform void fraction distribution can provide a reasonably uniform pressure drop through the entire fragmented mass. When forming a fragmented mass, it is important that formation within the retort site be fragmented and displaced, rather than simply fractured, in order to create a fragmented mass of generally high permeability; otherwise, too much pressure differential is required to pass a retorting gas through the retort. Preferably the retort contains a reasonably uniformly fragmented mass of particles so uniform conversion of kerogen to liquid and gaseous products occurs during retorting. A wide distribution of particle size can adversely affect the efficiency of retorting because small particles can be completely retorted long before the core of large particles is completely retorted.

The general art of blasting rock formations is discussed in *The Blaster's Handbook*, 15th Edition, published by E.I. DuPont de Nemours & Company, Wilmington, Del.

One method of explosive expansion involves use of a plurality of concentrated charges uniformly distributed throughout the formation to be expanded to produce a generally uniformly fragmented mass of formation particles. U.S. Pat. No. 3,434,757 to Prats teaches sequential detonation of a series of explosives in oil shale to form a permeable zone in the oil shale.

The aforementioned U.S. Pat. No. 4,118,071 discloses techniques for fragmenting a volume of formation containing oil shale to form a fragmented permeable mass in an in situ oil shale retort. In that patent, an in situ oil shale retort is formed in a subterranean formation containing oil shale by excavating a void in the form of a narrow slot having a vertically extending free face, drilling blasting holes adjacent to the slot and parallel to the vertical free face, loading explosive into the blasting holes, and detonating the explosive to expand the formation adjacent the slot toward the free face.

In forming a fragmented mass, formation within the retort site can be explosively expanded toward a vertical slot in a single round of explosions. Since each blasting hole in the retort site can contain as much as about eight tons of explosive, significant seismic effects can be produced from the single round of explosions. It is desirable to use blasting techniques that minimize the seismic effects from the explosive.

SUMMARY OF THE INVENTION

The present invention provides a method for explosively expanding oil shale formation toward a limited void for forming an in situ oil shale retort in a subterranean formation containing oil shale. At least one void is excavated in the subterranean formation. The remaining portion of unfragmented formation within the retort site forms at least one vertical free face adjacent the void. Explosive is placed in a set of a at least two rows of blasting holes in the remaining portion of unfragmented formation adjacent the vertical free face. Each succeeding row of blasting holes is spaced further from the vertical free face adjacent the void than the preceeding row and the rows are preferably substantially parallel to each other and to the vertical free face. The blasting holes in each row are longitudinally off-set from the blasting holes in the next adjacent rows. That is, adjacent rows of blasting holes will have a staggered or "saw-tooth" configuration. Explosive in the blasting holes is detonated in a time delay sequence progressing along the length of the set of blasting holes to thereby explosively expand the formation in the portion of unfragmented formation toward the vertical free face.

DRAWINGS

These and other aspects of the invention will be more fully understood by referring to the following detailed description and the accompanying drawings, wherein.

DETAILED DESCRIPTION

Figure 1:
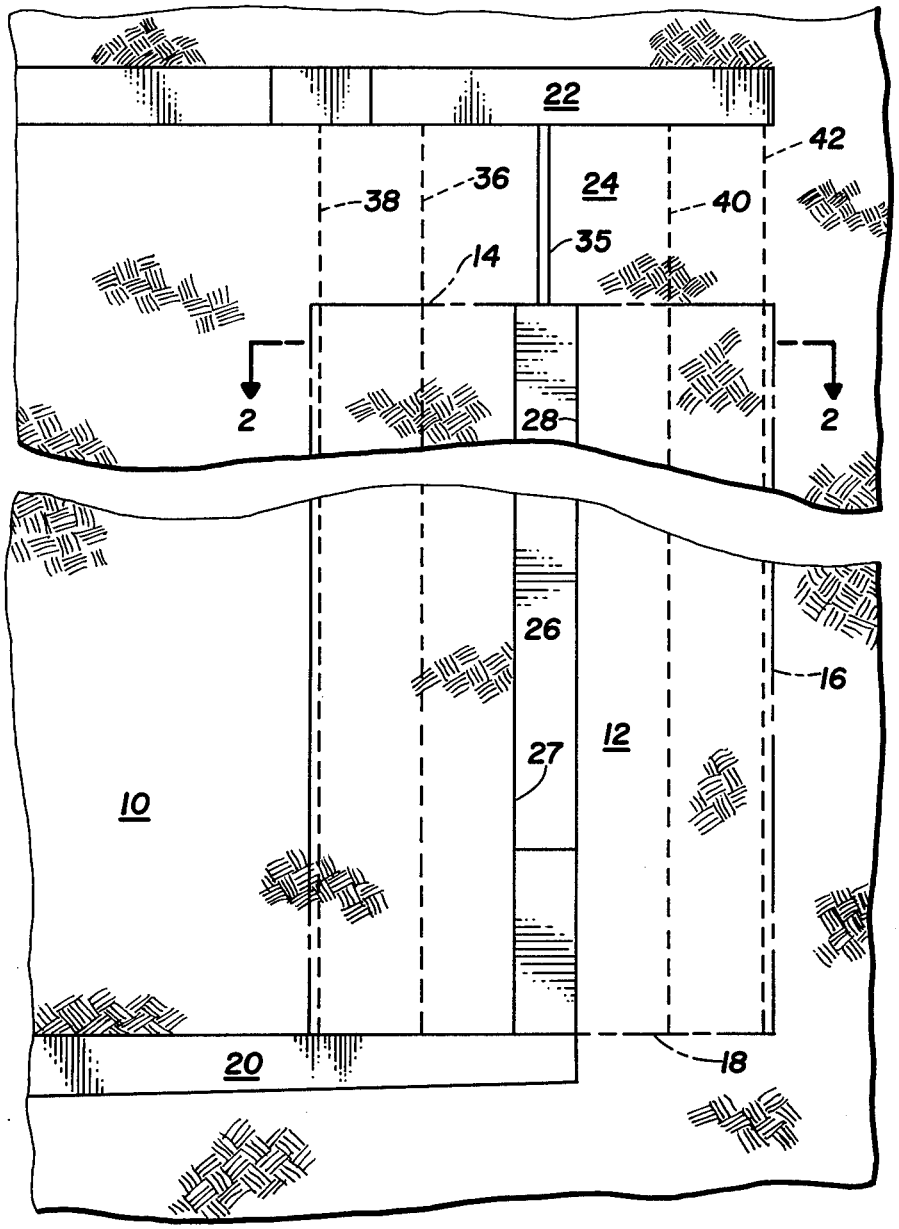
FIG. 1 is a fragmentary semi-schematic vertical cross-section taken on line 1—1 of FIG. 2 and showing an in situ oil shale retort site having a blasting pattern according to principles of this invention.

FIG. 1 shows a subterranean formation 10 containing oil shale in which an in situ oil shale retort is being formed in a retort site 12 within the formation. The in situ retort being formed is rectangular in horizontal cross-section, and as shown in phantom lines in FIG. 1, the retort being formed has a top boundary 14, four vertically extending side boundaries 16 and a lower boundary 18. A drift 20 at a production level provides a means for access to the lower boundary of the in situ oil shale retort. Formation excavated to form the drift is transported to above ground through an adit or a shaft (not shown).

The in situ oil shale retort is formed by excavating formation from above the retort site to form an open base of operation 22 on an upper working level. The floor of the base of operation is spaced above the upper boundary 14 of the retort being formed, leaving a horizontal sill pillar 24 of unfragmented formation between the bottom of the base of operation and the upper boundary of the retort being formed. The horizontal extent of the base of operation is sufficient to provide effective access to substantially the entire horizontal cross-section of the retort site. Such a base of operation provides an upper level means for access for for excavating operations for forming a void within the retort site. The base of operation also provides means for access for explosive loading for explosive expansion of formation toward such a void to form a fragmented permeable mass of formation particles in the retort being formed. The base of operation also facilitates introduction of oxygen supplying gas into the top of the fragmented mass formed below the horizontal sill pillar 24.

Figure 2:
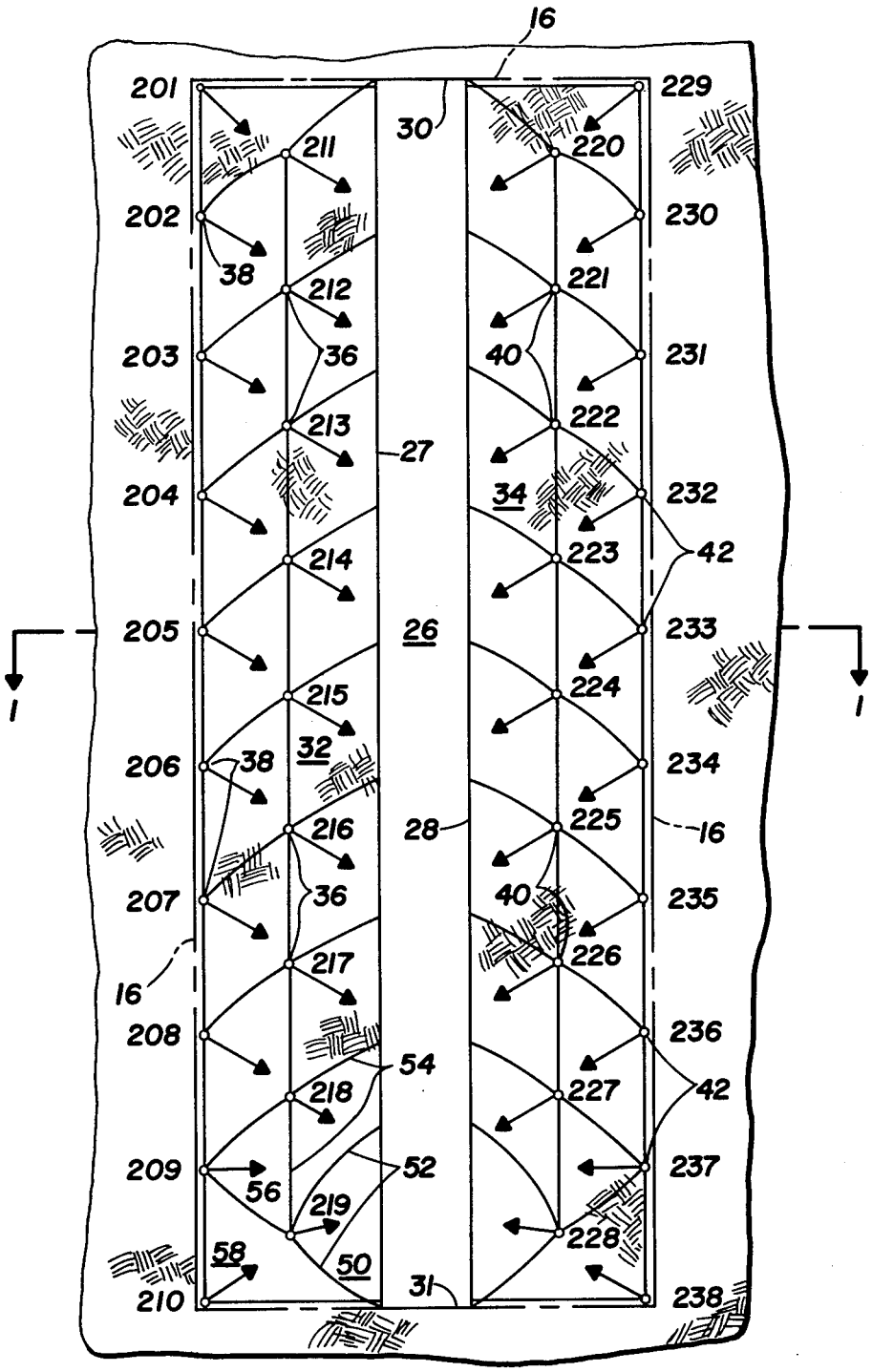
FIG. 2 is a semi-schematic horizontal cross-section taken on line 2—2 of FIG. 1; and, FIG. 3 is a fragmentary semi-schematic vertical cross-section showing a completed in situ oil shale retort formed according to principles of this invention.

The in situ oil shale retort is prepared by excavating a portion of formation from within the retort site to form at least one void. In the working embodiment illustrated in the drawings, the void is in the form of a narrow elongated vertical slot-shaped void 26, herein referred to as a vertical slot. In the working embodiment, one such vertical slot is shown in the center of the rectangular retort being formed, although more than one vertical slot can be formed within the retort site and/or the vertical slot can be positioned anywhere in the retort site if desired. The vertical slot extends between the production level drift 20 and the top boundary 14 of the retort being formed. The opposite long side walls of unfragmented formation adjacent the slot in the working embodiment provide parallel first and second free faces 27 and 28 of formation extending vertically through the retort site. The length of the slot extends essentially the entire distance between opposite side boundaries of the retort being formed, forming first and second end walls 30 and 31 of the slot adjacent opposite side boundaries of the retort site. As exemplified in FIG. 2, the slot is formed essentially in the center of the horizontal cross-section of the retort being formed, leaving a first zone 34 of unfragmented formation within the retort site adjacent the second free face 28. The length and width of the slot are best illustrated in FIG. 2. In an embodiment such as that shown in FIGS. 1 and 2, the slot can be from about 100 to about 500 feet in length and from about 20 feet to about 40 feet wide, and over about 250 feet in height, occupying about 20 to 25% of the volume within the retort being formed. FIG. 1 shows the upper portion of a vertical raise 35 initially bored through the retort site and subsequently used for forming the vertical slot. Techniques for forming the slot are described in the aforementioned U.S. Pat. No. 4,118,071.

The zones of unfragmented formation are explosively expanded toward the slot for forming a fragmented permeable mass 44 (see FIG. 3) of formation particles containing oil shale in an in situ oil shale retort. The unfragmented formation within the retort site is explosively expanded into a limited void volume provided by the vertical slot.

A test has been made in which a formation containing oil shale was explosively expanded towards a vertical free face by means of explosive in a vertically extending blasting hole wherein the volume into which the formation could expand was effectively unlimited. That is, the extent of expansion of the fragmented mass was not limited by confinement by adjacent formation so that the resultant fragmented mass did not completely fill the available void space. It was found that the formation "bulked" about 35%; that is, the total volume of the fragmented mass was about 35% greater than the volume of the formation fragmented to form the mass. This corresponds to an average void fraction in the fragmented mass of about 26%. Thus, free expansion of oil shale formation by such a technique requires a void volume of at least about 26% of the volume of formation explosively expanded.

By "limited void volume" is meant that the volume of the vertical slot is smaller than the volume required for free expansion of oil shale formation toward the slot. The volume of the slot is less than about 25% of the volume of the fragmented mass being formed, the preferred range being between about 15% and 25%. The blasting pattern and techniques described below facilitate expansion of oil shale formation toward a vertical free face of a limited void volume for forming a fragmented mass of particles suitable for in situ retorting of oil shale.

Following formation of the vertical slot, a set of at least two rows of mutually spaced apart blasting holes are drilled downwardly from the base of operation 22 through each of the first and second zones of unfragmented formation remaining within the retort site on opposite sides of the slot. The blasting holes extend from the floor of the base of operation to the lower boundary of the retort being formed and the blasting holes in each row are longitudinally displaced or off-set one from the other when veiwed in horizontal cross-section, in the plane of the vertical free face. The number of blasting holes in each row and the number of rows in each set are dependent on the thickness of unfragmented formation adjacent the vertical free face and the type of explosive being used, etc. The blasting holes can be arranged as shown in the exemplary working embodiment of FIG. 2, wherein nineteen blasting holes, each about 10 inches in diameter, are in two rows substantially parallel to each of the vertical free faces of the slot.

A first inner row of nine blasting holes 36 extends along the middle of the first zone 32 of unfragmented formation adjacent to the first free face 27, and a similar second inner row of nine blasting holes 40 extends along the middle of the second zone 34 of unfragmented formation adjacent to the second free face 28 of the slot. A first outer row of ten blasting holes 38 extends along the outer boundary of the first zone of unfragmented formation on the side of the first inner row opposite the first free face. A similar second outer row of ten blasting holes 42 extends along the opposite side boundary of the second zone of unfragmented formation and is spaced from the second inner row of blasting holes on a side thereof opposite the second free face 28. Each of the nine blasting holes in the first inner row has a correspondingly located blasting hole in the second inner row of blasting holes. Similarly, each of the ten blasting holes in the first outer row has a correspondingly located blasting hole in the second outer row. The blasting holes in each of the four rows are approximately equidistantly spaced apart.

The two rows of blasting holes on each side of the slot are thus parallel to one another, as well as being parallel to the free faces of the vertical slot.

In the blasting pattern illustrated in the working embodiment, the blasting holes in the first outer row are identified by the numerals 201 to 210, the blasting holes in the first inner row are identified by the numerals 211 to 219, the blasting holes in the second inner row are identified by the numerals 220 to 228, and the blasting holes in the second outer row are identified by the numerals 229 to 238. The blasting holes at opposite ends of the first and second inner rows are spaced inwardly from the ends of the slot. The blasting holes at the opposite ends of the first and second outer rows are placed near the outside boundaries, i.e., the corners of the retort being formed. The blasting holes in the inside rows are therefore offset longitudinally relative to the blasting holes in the outside rows. Preferably, each blasting hole in a corresponding inside row is placed at about the mid-point of the longitudinal distance between the closest blasting holes in the adjacent outside row. Thus, the blasting holes on each side of the slot follow a symmetrical saw-tooth pattern along the length of the slot.

Explosive in the blasting holes of FIG. 2 is detonated in a time delay sequence progressing along the length of each set of blasting holes from near one end of the slot toward the opposite end of the slot. The time delay sequence of explosions in the round progresses in the same direction along each row of each set of blasting holes. The arrows in FIG. 2 show the general direction of particle motion due to each resultant explosion. The solid lines passing through the blasting holes in FIG. 2 illustrate the areas of fragmentation resulting from each explosion and thereby illustrate the new free faces created by the consecutive explosions. The first zone 32 of formation is explosively expanded toward the slot in a single round of explosions starting with blasting hole No. 219 which explosively expands a generally wedge-shaped segment of formation 50 toward the slot. Blasting hole No. 219 is at the apex of the wedge-shaped segment, and the blast creates a new generally V-shaped free face 52 running diagonally away from one side of the blasting hole toward the corner of the slot and running diagonally away from the other side of the blasting hole to an intersection with the first free face at a longitudinal location between blasting holes Nos. 209 and 218. Blasting hole 218 is fired next, expanding formation toward the newly created free face 52, thereby creating a new generally V-shaped free face running roughly between blasting holes Nos. 218 and 219 and then running diagonally to intersect the first free face of the slot approximately in line with blasting hole No. 208. Blasting hole No. 209 is fired next, which expands a generally wedge-shaped segment of formation toward portions of the previously formed free faces 52 and 54, thereby creating a new free face 56 running in one direction toward blasting hole No. 219 and in the other direction toward blasting hole No. 218. Blasting hole No. 210 is fired next in the time delay sequence to expand a generally triangular segment of formation 58 from the corner of the first zone of formation toward portions of the previously formed free faces 54 and 56. The sequence of blasting through blasting hole No. 210 expands an end region of the first zone of formation toward the slot. After this, blasting progresses along the length of the slot alternately between a blasting hole in the first inside row and then a blasting hole in the first outside row. Thus, blasting hole No. 217 is fired next, followed by blasting hole No. 207, blasting hole No. 216, et seq., through blasting hole No. 201.

A similar time delay sequence of blasting is used for the second inside and outside rows of blasting holes 220 through 238 in the second zone 34 of formation along the opposite side of the slot.

The blasting pattern described for FIG. 2 sequentially expands separate segments of formation toward the slot so that each explosion in the round has substantially the same zone of influence along the length of the slot. This enhances generally uniform fragmentation of formation within the retort site. When explosive expansion is initiated from a blasting hole at the end of a vertical slot, expansion of formation from the first explosion can be somewhat confined, since there is a generally small available free face toward which the first explosion is directed. Such confinement can cause "end effects" such as wedging of formation and reduced expansion of formation at the end of the slot compared with less confinement and more highly expanded formation along the remaining portion of the slot. Such end effects also can result in non-uniform breakage of formation at the ends of the slot, as well as less efficient use of explosive in blasting holes at the end of the slot than in the remaining blasting holes. Such end effects are minimized by the blasting pattern of FIG. 2, in which explosive expansion is initiated in blasting holes spaced inwardly from the end of the slot. The inwardly spaced blasting holes in which the blasting sequence is initiated are the ones located nearest the end of the slot and in the row closest to the slot. This results in formation being expanded toward a longer free face than if detonation is initiated adjacent the end of the slot. Expansion toward such a greater free face does not confine or limit the freedom of the first layer of formation to be expanded toward the slot, thereby allowing more freedom of expansion of the first layer of formation, which minimizes end effects.

The blasting holes are loaded with explosive up to a level corresponding to the top boundary 14 of the retort being formed. The upper portions of the blasting holes which extend through the sill pillar 24 are loaded with an inert stemming material such as sand or gravel. Explosive in the blasting holes is detonated in a single round of explosions, i.e., in an uninterrupted series of explosions. Detonation of explosive in the blasting holes expands formation toward the first and second free faces of the slot, forming the fragmented mass 44 (illustrated in FIG. 3) within the boundaries of the in situ retort site. Detonation of the explosive for forming the fragmented mass leaves the sill pillar 24 of unfragmented formation between the top of the fragmented mass and the floor of the upper base of operation 22.

Explosive in each row of blasting holes is detonated in a time delay sequence progressing along the length of the row of blasting holes for progressively expanding corresponding portions of formation along the length of the slot toward the adjacent free face of the slot. The progressive time delay sequence preferably is initiated near one end of the slot and progresses along the length of the slot toward the opposite end of the slot. Detonation of explosive in each blasting hole creates a new free face, and the progressive time delay sequence of explosions expands each consecutive portion of formation at least in part toward an adjacent new free face created by a previous explosion.

The time delays for the working embodiment in FIG. 2 are provided by commercially available explosive delay devices having the desired total delay. Some variation in the actual timing can occur due to random deviation from the stated values and small superimposed time delays from detonating cord used to initiate the delay devices. These variations do not alter the sequences described herein.

In the embodiment of FIG. 2, each blasting hole in the first inner row corresponds to a similarly located blasting hole in the second inner row. Similarly each blasting hole in the first outer row corresponds to a blasting hole in the second outer row. That is, each blasting hole in the first set of blast holes has a corresponding blasting hole in the set of blast holes on the opposite side of the slot located the same distance from an end of the slot. In the illustrated embodiment, explosive in the two inner rows of blasting holes can be detonated in a time delay sequence alternating between the first inside row and the second inside row. That is, explosive can be detonated with a short time delay between explosions in corresponding pairs of blasting holes on opposite sides of the slot. In this arrangement explosive in each corresponding pair of blasting holes is detonated in the next corresponding pair of blasting holes in the ordered sequence progressing along the length of the slot. Stated another way, formation adjacent the first and second free faces can be explosively expanded by alternately blasting portions of formation toward one free face and then the other, progressing in the same direction along the length of the slot.

In an alternative arrangement, each corresponding pair of blasting holes on opposite sides of the slot can be detonated simultaneously, with time delays between the simultaneous explosions so that the pairs of explosions progress from one end of the slot to the other end of the slot.

Preferably, a short time delay occurs between each successive detonation so that no two blasting holes in the entire blasting pattern are detonated simultaneously. This minimizes seismic effects from the explosive. The significance of this can be appreciated when it is recognized that each blasting hole can contain from about four to eight tons of explosive.

If explosive in two blasting holes is detonated substantially simultaneously it is preferred that the two blasting holes be located on opposite sides of the slot. The slot has a substantial effect in attenuating seismic waves and inhibits reinforcement of such waves from the two blasting holes when located on opposite sides of the slot.

Figure 3:
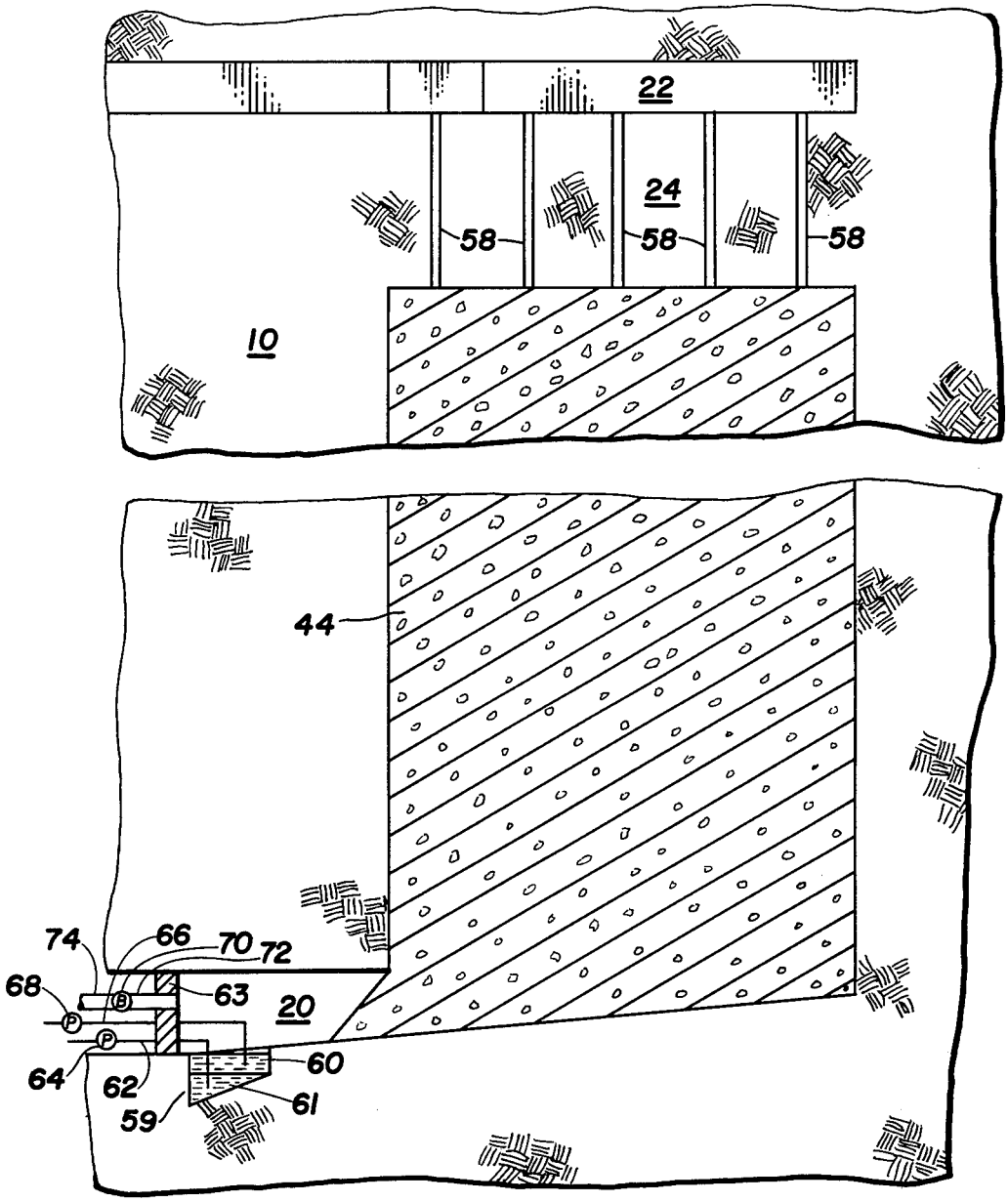

FIG. 3 illustrates a completed in situ retort in which shale oil is produced from the fragmented mass 44. The particles at the top of the fragmented mass are ignited to establish a combustion zone at the top of the fragmented mass. Air or other oxygen supplying gas is supplied to the combustion zone from the base of operation 22 through conduits or passages 58 extending downwardly from the base of operation through the sill pillar 24 to the top of the fragmented mass. The passages can be the upper ends of blasting holes extending through the sill pillar. Air or other oxygen supplying gas introduced to the fragmented mass through the conduits maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 59 and a portion of the production level drift 20 beyond the fragmented mass collect liquid products, namely, shale oil 60 and water 61 produced during operation of the retort. A water withdrawal line 62 extends from near the bottom of the sump out through a sealed opening (not shown) in a bulkhead 63 sealed across the access drift. The water withdrawal line is connected to a water pump 64. An oil withdrawal line 66 extends from an intermediate level in the sump out through a sealed opening (not shown) in the bulkhead and is connected to an oil pump 68. The oil and water pumps can be operated manually or by automatic controls (not shown) to remove shale oil and water separately from the sump. The inlet of a blower 70 is connected by a conduit 72 to an opening through the bulkhead for withdrawing off gas from the retort. The outlet of the blower delivers off gas from the retort through a conduit 74 to a recovery or disposal system (not shown).

What is claimed is:

1. A method for recovering liquid and gaseous products from an in situ oil shale retort formed in a retort site in a subterranean formation containing oil shale, such an in situ oil shale retort containing a fragmented permeable mass of formation particles containing oil shale, comprising the steps of:

excavating at least one void in formation within the retort site, leaving a remaining portion of unfragmented formation within the retort site forming at least one vertical free face adjacent such a void, the volume of the excavated void being less than about 25% of the volume of the fragmented mass being formed;

placing explosive in at least two rows of blasting holes in such remaining portion of unfragmented formation adjacent such a vertical free face, said blasting holes in each row being mutually spaced apart along the length of the void and longitudinally off-set from blasting holes in the next adjacent row;

detonating explosive in said blasting holes in a time delay sequence progressing along the length of the row of blasting holes for explosively expanding formation in said remaining portion of unfragmented formation toward said vertical free face for forming at least a portion of a fragmented permeable mass of formation particles containing oil shale in an in situ oil shale retort;

establishing a combustion zone in an upper portion of the fragmented mass and advancing the combustion zone through the fragmented mass for producing liquid and gaseous products of retorting; and withdrawing liquid and gaseous products of retorting from a lower portion of the fragmented mass.

2. The method according to claim 1 in which explosive in said blasting holes is detonated in a single round of explosions.

3. The method according to claim 1 in which the rows of blasting holes are substantially parallel to the free face.

4. The method according to claim 3 in which the void comprises an elongated vertical slot having a length similar to the length of the fragmented mass being formed.

5. The method according to claim 1 in which explosive in the blasting holes within said rows are detonated in the same order in which the blasting holes are located along the length of the void.

6. The method according to claim 1 in which detonation of explosive in each blasting hole produces a separate generally wedge-shaped free face adjacent the void.

7. The method according to claim 1 in which the time delay sequence is initiated in a blasting hole closest to one end of the void and progresses toward a blasting hole closest to the opposite end of the void.

8. In a method for explosively expanding oil shale formation toward a limited void volume provided by a void excavated in a retort site in formation containing oil shale, wherein said void has at least one vertical free face, the improvement comprising the steps of:

placing explosive in at least two rows of blasting holes in a remaining portion of unfragmented formation within the retort site adjacent such a vertical free face, said blasting holes in each row being mutually spaced apart along the length of the void and longitudinally off-set from blasting holes in the next adjacent row; and detonating explosive in the blasting holes in a single round in a time delay sequence progressing along the length of the rows of blasting holes for explosively expanding formation in said remaining portion of unfragmented formation toward such vertical free face for forming at least a portion of a fragmented permeable mass of formation particles containing oil shale in an in situ oil shale retort.

9. The improvement according to claim 8 in which the rows of blasting holes are substantially parallel to the free face.

10. The improvement according to claim 9 in which the time delay sequence is initiated near one end of the void and progresses toward the opposite end of the void.

11. The improvement according to claim 10 in which explosive in the blasting holes within said rows are detonated in the same order as the order in which the blasting holes are located along the length of the void.

12. A method for explosively expanding oil shale formation toward a limited void volume for forming an in situ oil shale retort within a retort site in a subterranean formation containing oil shale, the retort containing a fragmented permeable mass of formation particles containing oil shale, comprising the steps of:

excavating at least one slot-shaped void in formation within the retort site, leaving separate first and second portions of unfragmented formation within the retort site forming first and second vertical free faces of formation extending along opposite sides of the void;

placing explosive in a first set of blasting holes comprising at least two rows of blast holes in said first portion of unfragmented formation adjacent the first free face and in a second set of blasting holes comprising at least two rows of blast holes in said second portion of unfragmented formation adjacent the second free face wherein each row of blasting holes in each set is longitudinally off-set from the blasting holes in the next adjacent row in that set; and detonating explosive in each set of blasting holes in a time delay sequence progressing along the length of the void for explosively expanding formation in said first and second portions of unfragmented formation toward the first and second vertical free faces for forming at least a portion of a fragmented permeable mass of formation particles containing oil shale in an in situ oil shale retort.

13. The method according to claim 12 in which the time delay sequence of explosions in the first set of blasting holes is in the same direction along the length of the void as the time delay sequence in the second set of blasting holes.

14. The method according to claim 12 wherein each of the blasting holes in the first portion of unfragmented formation corresponds to a similarly located blasting hole in the second portion of unfragmented formation; and wherein explosive in each such pair of corresponding blasting holes is detonated essentially simultaneously.

15. The method according to claim 12 wherein each of the blasting holes in the first portion of unfragmented formation corresponds to a similarly located blasting hole in the second portion of unfragmented formation; and including the step of detonating such explosive with a time delay between explosions in each such pair of corresponding blast holes.

16. The method according to claim 12 wherein each of the blasting holes in the first portion of unfragmented formation corresponds to a similarly located blasting hole in the second portion of unfragmented formation; and, wherein explosive in each such pair of corresponding blasting holes is detonated prior to detonating explosive in the next corresponding pair of blasting holes in said time delay sequence.

17. The method according to claim 16 in which explosive in such pairs of corresponding blasting holes is detonated in a time delay sequence having the same order as the order in which such pairs of corresponding blasting holes are located along the length of the void.

18. The method according to claim 12 wherein each row of blasting holes is substantially parallel to a respective vertical free face of the slot.

19. The method according to claim 18 in which explosive in each row of blasting holes is detonated in a time delay sequence starting near one end of the slot and progressing in the same direction toward the opposite end of the slot.

20. The method according to claim 12 in which detonation of explosive alternates between blasting holes on opposite sides of the slot-shaped void.

21. The method according to claim 12 further comprising avoiding simultaneous detonation of explosive in two blasting holes on the same side of the slot-shaped void.

22. A method for forming an in situ oil shale retort in a retort site in a subterranean formation containing oil shale, the retort containing a fragmented permeable mass of formation particles containing oil shale, comprising the steps of:

excavating at least one void in formation within the retort site, leaving a remaining portion of unfragmented formation within the retort site forming at least one vertical free face adjacent such a void, the volume of the void being less than about 25% of the volume of the fragmented mass being formed;

placing explosive in at least a first row and a second row of blasting holes in said remaining portion of unfragmented formation, said first row being adjacent the free face and said second row being spaced from the first row on a side thereof opposite the free face, the blasting holes in said second row being longitudinally displaced from the blasting holes in said first row; and detonating explosive in a single round in each row of blasting holes in a time delay sequence starting near one end of the void and progressing along the length of each row of blasting holes toward the opposite end of the void for explosively expanding formation in said remaining portion of unfragmented formation toward the vertical free face for forming at least a portion of a fragmented permeable mass of formation particles containing oil shale in an in situ oil shale retort.

23. The method according to claim 22 wherein each blasting hole in the first row is paired to a blasting hole in the second row; and including the step of detonating such explosive with a time delay between explosions in each such pair of corresponding blasting holes.

24. The method according to claim 22 in which explosive in each row is detonated in a time delay sequence progressing in the same direction along the length of the void.

25. The method according to claim 22 wherein each row of blasting holes is substantially parallel to the free faces of the slot.

26. The method according to claim 22 in which detonation of explosive in each blasting hole in the first row forms a separate new free face; and in which detonation of explosive in each blasting hole in the second row explosively expands formation toward a corresponding new free face previously formed from detonating explosive in an adjacent blasting hole in the first row.

27. A method for explosively expanding oil shale formation toward a limited void volume for forming an in situ oil shale retort in a retort site in a subterranean formation containing oil shale, the retort containing a fragmented permeable mass of formation particles containing oil shale, comprising the steps of:

excavating at least one slot-shaped void in formation within the retort site, leaving separate right and left portions of unfragmented formation within the retort site forming right and left vertical free faces of formation extending along opposite sides of the void;

placing explosive in at least a first and a second row of blasting holes in the right portion of unfragmented formation, said first row being adjacent the right free face and the second row being spaced from the first row to a side thereof opposite the right free face, the blasting holes in each of said rows being longitudinally displaced from the blasting holes in the next adjacent row in that portion of unfragmented formation;

placing explosive in at least a third and a fourth row of blasting holes in the left portion of unfragmented formation, the third row being adjacent the left free face and the fourth row being spaced from the third row on a side thereof opposite the left free face, the blasting holes in each of said rows being longitudinally displaced from the blasting holes in the next adjacent row in that portion of unfragmented formation;

detonating explosive in a single round in each row of blasting holes in a time delay sequence progressing in the same direction along the length of each row of blasting holes for explosively expanding formation in said right and left portions of unfragmented formation toward the right and left vertical free faces for forming at least a portion of a fragmented permeable mass of formation particles containing oil shale and an in situ oil shale retort.

28. The method according to claim 27 in which explosive in each of the blasting holes in the first and third rows is detonated before detonating explosive in adjacent blasting holes in the second and fourth rows, respectively.

29. A method for forming an in situ oil shale retort in a retort site in a subterranean formation containing oil shale, the retort containing a fragmented permeable mass of formation particles containing oil shale, comprising the steps of:

excavating a portion of formation from within the retort site to form at least one slot, the surface of formation defining the walls of the slot providing a pair of substantially parallel first and second free faces extending vertically through formation within the retort site, leaving first and second portions of unfragmented formation within the retort site adjacent the first and second vertical free faces of the slot, the volume of the slot being less than about 25% of the volume of the fragmented mass being formed, the slot having a length similar to the length of the fragmented mass being formed;

placing explosive in separate substantially parallel rows of vertical blasting holes in the first and second portions of unfragmented formation, respectively, the blasting holes in each of said rows being longitudinally off-set relative to the blasting holes in the next adjacent row in that portion of unfragmented formation; and detonating explosive in each row of blasting holes in a time delay sequence starting near one end of the void and progressing in the same direction along the length of each row of blasting holes toward the opposite end of the void for explosively expanding formation in said first and second portions of unfragmented formation toward the first and second free faces of the slot, respectively, for forming a fragmented permeable mass of formation particles containing oil shale in an in situ oil shale retort.

30. The method according to claim 29 wherein the detonation of explosive alternates between blasting holes on opposite sides of the slot.

31. The method according to claim 29 further comprising avoiding simultaneous detonation of explosive in two blasting holes on the same side of the slot.

* * * * *